United States Patent [19]

Kreysa et al.

[11] 4,430,175

[45] Feb. 7, 1984

[54] PROCESS FOR THE ELECTROCHEMICAL CONVERSION OF COAL AND USE OF THE REACTION PRODUCTS

[75] Inventors: Gerhard Kreysa, Wehrheim; Gerd Collin, Duisburg, both of Fed. Rep. of Germany

[73] Assignee: Rütgerswerke Aktiengesellschaft, Frankfurt am Main, Fed. Rep. of Germany

[21] Appl. No.: 449,952

[22] Filed: Dec. 15, 1982

[30] Foreign Application Priority Data

Dec. 22, 1981 [DE] Fed. Rep. of Germany ..... 3150729

[51] Int. Cl.[3] ..... C25B 3/00; C25B 3/02

[52] U.S. Cl. ..... 204/72; 204/78; 204/80; 204/130; 208/8 R; 208/8 LE

[58] Field of Search ..... 204/130, 72, 78, 80

[56] References Cited

U.S. PATENT DOCUMENTS

| | | | |
|---|---|---|---|
| 2,807,577 | 9/1957 | Antonsen | 204/130 |
| 3,746,506 | 7/1973 | Aitken | 204/130 |
| 3,865,705 | 2/1975 | Rieux et al. | 204/130 |
| 4,043,881 | 8/1977 | Yen et al. | 204/130 |
| 4,043,884 | 8/1977 | Yen et al. | 204/130 |

*Primary Examiner*—John F. Niebling

*Attorney, Agent, or Firm*—Beveridge, DeGrandi & Kline

[57] ABSTRACT

Ground coal is dispersed in an aqueous electrolyte and is alternately oxidized anodically and reduced cathodically. The reaction gases and the liquid hydrocarbons obtained and other volatile organic compounds are processed and used in the customary manner. The reactive groups formed in the coal improve its cokeability, extractability and capacity for hydrogenation. In addition, the treated coal because of its good wettability, suspended in water or alcohol, is well suited as a liquid fuel or motor fuel.

10 Claims, 2 Drawing Figures

Figure 1:
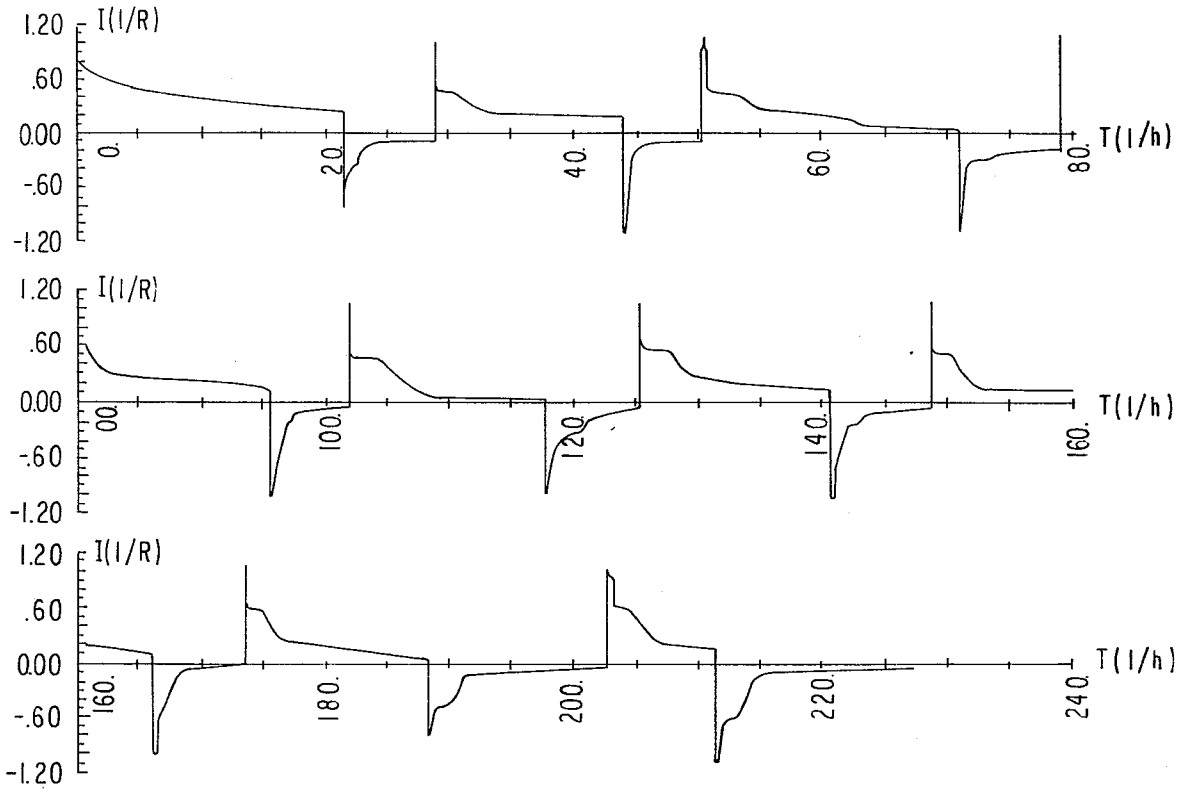

PROCESS FOR THE ELECTROCHEMICAL CONVERSION OF COAL AND USE OF THE REACTION PRODUCTS

The invention relates to a process for the electrochemical conversion of coals in aqueous electrolyte solutions utilizing an electrolysis cell, as well as the use of the reaction products obtained thereby.

The increasing shortage of petroleum and the uncertainty concerning the availability of this raw material have led to an increased interest in the utilization of alternative sources of raw material. Coal is quantitatively as well as with regard to its distribution on earth, a readily available alternative for petroleum. Since coal is a solid substance is more difficult to handle in most cases and is not as universally applicable as petroleum, there was no lack of attempts to convert coal into liquid or gaseous products. Most highly developed were the thermal conversion processes, to which must also be added, in addition to the gasification and liquefaction of coal, the coking especially of hard coal. Coking processes which at the present time are the only economically operated processes are based on a long, continuous development. The greatest problem at the present time is the increasing shortage of coal suitable for being coked. Attempts have also been made to disperse coal that has been ground as fine as dust in a fluid such as, for example, water or oil, and to use the mixture as an energy or motor fuel. The disadvantage of this process is to be seen in the fact that the coal particles without the addition of dispersing agents are inclined to settle out of the mixture and to cause sedimentation.

Furthermore, from the publications of Coughlin and Farooque (Ind. Eng. Chem. Prod. Res. Dec. 19, 211 (1980)/Fuel, 58, 705 (1979)/Journal of Applied Electrochemistry 10, 729 (1980) and from the publication of Bockris et al (J. Electrochem. Soc.: Electrochemical Science and Technology, Vol. 128, No. 10, 2097 (1981), it has been known to electrolyze aqueous coal suspensions. These publications are relied on and incorporated herein by reference. They succeeded in developing hydrogen on the cathode with simultaneous $CO_2$ formation on the anode in a stirred laboratory cell with an anode from a stirred suspension of coal in sulfuric acid into which a platinum electrode is submerged at a cell voltage which amounted to only about half the amount customary in the case of decomposition of water. During the electrolysis time however, the current amperage and thus the production of hydrogen decreased rapidly. The passivated coal had to be renewed or thermally regenerated.

It is the object of the invention to develop an effective process for the electrochemical conversion of coal in aqueous electrolytes, whereby it is not necessary to thermally regenerate the coal and to find an advantageous use for the reaction products.

The object of the invention was achieved by an electrolysis process in a cell, wherein the electrolyte is at ambient temperature or heated to a maximum of its boiling temperature and the ground coal is dispersed in the electrolyte and is alternately anodically oxidized and cathodically reduced at predetermined intervals. The concentration of the coal in the slurry can vary widely as, for example, from 10 to 500 kg/m$^3$ with no dispersing agent being necessary. This takes place in a divided cell either through the fact that the anode or the cathode are mutually exchanged by changing the polarity at certain intervals or in which the coal suspension flows first through the one and subsequently through the other chamber. The latter variation is particularly advantageous, since the process gases are obtained in greater purity separately, and moreover in that as a cathode material, a material with high hydrogen overpressure may be used. It is likewise possible to operate in a subdivided cell in which the coal is guided alternately by suitable convection to the anode and to the cathode. Advantageously, several cells are combined into a block through which in succession material flow quasi-continuously. In this development, 90% of the finely divided coal has a grain size of less than 63 $\mu$m, although the size can vary. The time intervals for alternately oxidizing and reducing may be between 10 minutes and 10 hours, preferably 0.5 to 2 hours. The polarity may be changed by hand or automatically, for instance, by a stepping relay. The voltage of the cell is between 0.8 and 2.2 V and the current density is 0.4 to 6 mA/cm$^2$.

In FIG. 1, the course of the density of the current in the cell is shown during the time. In this case, a solid bed made of graphite balls of 0.5 cm diameter was used as an electrode with an electrochemically active surface of 1733 cm$^2$. The current density peaks develop in the first place as a result of the $Fe^{2+}/Fe^{3+}$ conversion. The cathodic activation of the anodically oxidized coal may be recognized clearly. The oxidation of the coal however is reversed only to a small part by the cathodic reduction which follows. Thus, the coal is oxidized to an increasing measure. At the same time, there is formed in addition the soluble phenols and carboxylic acids, which are obtained in a known manner from the electrolyte, spectrascopically provable carbonyl groups in the coal itself, which point to the formation of humic acids as well as secondary alcohol and ether groups.

As a result of the new formation of these reactive groups, it is possible to improve the capacity for hydrogenation of the coal. The coal becomes extractable with alkaline solutions. As a result of the cathodic reduction, the molar H/C ratio in the pyridine extract increases as compared to the coal charged. The coal is extracted with boiling pyridine and the dissolved coal is termed the "pyridine extract". In the example described with the solid bed electrode made of graphite balls, the H/C ratio rises, for example, from 0.867 to 0.917. The new formation, especially of the carbonyl groups, leads to an improved cokeability of the treated coal, above all in the case of the use of hard coals suitable for being coked. Furthermore, the wettability of the coal is increased so that, with water or alcohols, it is possible to form stable suspensions for use as liquid energy or motor fuel.

The following Examples are closely related to elemental analyses, in that the chemical composition of coal is altered through the electrochemical process of the present invention. The electrochemical transformation of coal in the anodic step proceeds to over 90% in an indirect mechanism by means of which a Redox system oxidizes the coal and is recovered in situ in the electrolytic cell. As oxidation means one can utilize the $Fe^{3+}$ (Example 1) obtained through the solution of the pyrites contained in the coal, or one can also utilize another oxidation means with a normal potential higher than 0.5 V (Example 2).

EXAMPLE 1

42.1 g coal were suspended in 130 ml (about 30% suspension) of 1 m $H_2SO_4$ in the described electrolytic cell with a solid bed electrode of graphite particles having a diameter of 0.5 cm. This suspension was electrolyzed with the polarization program described in FIG. 1. After achieving an anodic load of 6 Ah (ampere-hour) (Corresponding to 0.14 Ah/g), it was converted to a cathodic polarization. After achieving a cathodic load of 2.3 Ah (Corresponding to 0.05 Ah/g) there followed again an anodic charge. From the elemental analysis of the coal before and after electrolysis, there was obtained the following stochiometric composition based on 100 C-atoms:

| | C | H | O | N | S |
|---|---|---|---|---|---|
| Before the electrolysis | 100 | 80.9 | 8.6 | 1.7 | 0.8 |
| After electrolysis | 100 | 72.2 | 11.7 | 1.8 | 0.5 |

EXAMPLE 2

30 g starting coal (particle size≦500 μm) were suspended in 210 ml 1 m $H_2SO_4$ in a cup-shaped electrolytic cell with a concentric working electrode (platinized titanium) of 256 $cm^2$ surface and a cable-shaped counter-electrode (Pt) of 2.36 $cm^2$ surface, said $H_2SO_4$ containing 30 g $(Ce(SO)_4)_2.4H_2O$. With stirring at a temperature of 70°–75° C. over a period of 45.3 hours, the working electrode was anodically polarized with a potential of +1500 mV (against the "Calomel" electrode) whereby a collective load of 2.50 Ah/g was taken up by the coal. The production of $CO_2$ through absorption of CaO amounted to 56%. Consquently, cathodic electrolyzation was effected over a period of 74 hours with a potential of −340 mV (GKE), whereby a load of 1.25 Ah/g was achieved. Of this, 0.066 Ah/g served for the transfer of $Ce^{4+}$ to $Ce^{3+}$. From the elemental analysis of the coal before and after the electrolysis there resulted the following stochiometric composition based on 100 C-atoms:

| | C | H | O | N | S |
|---|---|---|---|---|---|
| Before electrolysis | 100 | 80.9 | 8.6 | 1.7 | 0.8 |
| After electrolysis | 100 | 79.8 | 12.04 | 1.6 | 0.5 |

For the types of use mentioned, the electrochemically treated coal is separated from the electrolyte in a known manner, for example, by filtration or in decanter or sieve centrifuges, is subsequently washed and dehydrated. The total reaction time can vary widely, for example, from 12 to 60 hours or longer.

The $CO_2$/CO containing gas developing on the anode, as with the hydrogen containing gas developing on the cathode, contains besides steam also readily boiling aromatics, especially benzene aromatic hydrocarbons, which after condensation, are separated from the water and are processed and use in the customary manner. The dried gases separated from condensable aromatic hydrocarbons or other organic compounds may be used singly or mixed into a synthesis gas.

Figure 2:
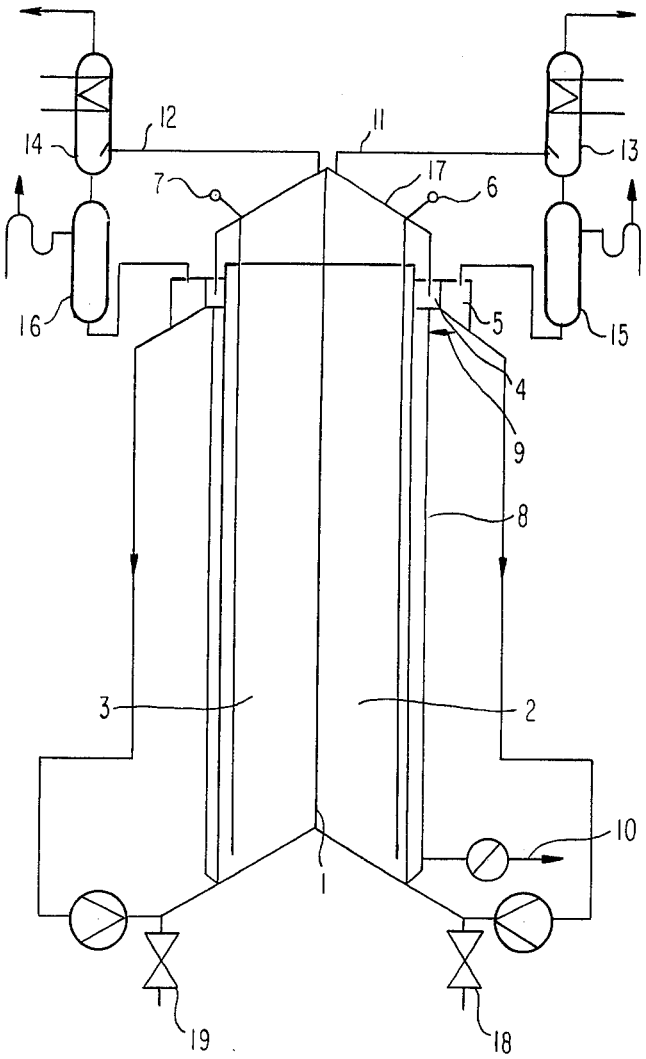

The process according to the invention will be explained on the basis of the electrolysis cells shown in FIG. 2 with electrodes that may be made to change polarity, without limitation to the arrangement of the apparatus.

The coal slag dispersed in aqueous sulfuric acid, is fed into the chambers 2 and 3 of the electrolysis cell separated by a membrane 1 and is transferred by pumping. The membrane is a separator made of fitted glass, a ceramic diaphragm or a fluorinated plastic. The chamber may be made of glass, enamel, coated metal or resistant plastic. At the same time, the overflowing suspension is returned again by way of the liquid immersion bath 4 and the collecting funnel 5 into the lower part of the corresponding chamber. In the chambers 2 and 3, electrodes 6 and 7 made of platinum coated titanium are disposed which alternately are connected as anodes or cathodes. For the anode, materials such as platinum, activated titanium or graphite may be used. As the cathode, platinum, activated titanium, graphite, lead, cadimum or zinc are suitable. The electrolysis cell is provided with a double jacket 8 into which steam is fed by way of the sleeve 9 in order to heat the electrolyte to its boiling temperature. The condensate flows off by way of the steam trap 10. The gas-steam mixture forming in the chambers 2 and 3 reaches the condensers 13 and 14 by way of the lines 11 and 12, where the steam and the vapors of the aromatics are condensed. The discharging condensates are separated in the separating containers 15 and 16, whereby the water is returned into the electrolyte circuit and the aromatics are sluiced out continuously. The steam is normal steam used for heating and is at a temperature of 100° C. to 150° C. Other means of heating may also be used. The chambers 2 and 3 are covered with a hood 17 which with the help of a liquid immersion bath 4, seals the gas chamber against its environment. The electrochemically converted coal is discharged by way of the connections 18 and 19 with the electrolyte and is separated from it by filtration or decanting. Possibly after separation of the phenois and carboxylic acids, the electrolyte is again mixed with freshly ground coal and is returned into the cell.

In the technical embodiment, several cells are combined in parallel or in succession into a unit.

In applicants' work, an aqueous solution of 1 to 6 mole sulfuric acid in 1 $dm^3$ of the electrolyte was used. Ethylamine with LiCl as a conducting salt is also known as a suitable electrolyte.

We claim:

1. A process for the electrochemical conversion of coal comprising forming a finely divided coal suspension in a dilute mineral acid solution in an electrolyte cell, alternately subjecting said suspension to anodic and cathodic polarization to thereby obtain a change in the chemical composition of the coal as may be determined by an elemental analysis of the coal before and after electrolysis.

2. A process as claimed in claim 1, wherein an inorganic salt is present in the dilute mineral acid solution.

3. In a process for the electrochemical conversion of coal in aqueous electrolytes in an electrolysis cell, the improvement which comprises subjecting the electrolyte, at ambient temperature and the ground coal dispersed in the electrolyte, to alternately anodic oxidation and cathodic reduction at temporal intervals.

4. The process as in claim 3, wherein the alternating anodic oxidation and cathodic reduction takes place in an electrolysis cell separated by a membrane into two chambers by change of polarity of the electrodes while obtaining the process gases and the liquid hydrocarbons and other volatile organic compounds.

5. The process as in claim 3, wherein the alternating anodic oxidation and cathodic reduction takes place in an electrolysis cell separated by a membrane into two chambers by transfer through pumping of the coal suspension from one electrolysis chamber into the other chamber while obtaining the process gases and the liquid hydrocarbons and other volatile organic compounds.

6. The process as in claim 3, wherein the alternating anodic oxidation and the cathodic reduction takes place in a subdivided cell and the coal suspension is guided by convection alternatingly to the anode and to the cathode.

7. In a process for the electrochemical conversion of coal in aqueous electrolytes in an electrolysis cell, the improvement which comprises subjecting the electrolyte, heated up to its boiling temperature and the ground coal dispersed in the electrolyte, to alternately anodic oxidation and cathodic reduction at temporal intervals.

8. The process as in claim 7, wherein the alterating anodic oxidation and the cathodic reduction takes place in a subdivided cell and the coal suspension is guided by convection alternatingly to the anode and to the cathode.

9. The process as in claim 7, wherein the alternating anodic oxidation and cathodic reduction takes place in an electrolysis cell separated by a membrane into two chambers by change of polarity of the electrodes while obtaining the process gases and liquid hydrocarbons and other volatile organic compounds.

10. The process as in claim 7, wherein the alternating anodic oxidation and cathodic reduction takes place in an electrolysis cell separated by a membrane into two chambers by transfer through pumping of the coal suspension from one electrolysis chamber into the other chamber while obtaining the process gases and the liquid hydrocarbons and other volatile organic compounds.

* * * * *